US007560664B2

(12) United States Patent
Ford et al.

(10) Patent No.: US 7,560,664 B2
(45) Date of Patent: Jul. 14, 2009

(54) THERMAL GARMENTS

(76) Inventors: Ancil Ford, 5854 Renault Dr. West, Jacksonville, FL (US) 32244; Burnette Ford, 5854 Renault Dr. West, Jacksonville, FL (US) 32244

( * ) Notice: Subject to any disclaimer, the term of this patent is extended or adjusted under 35 U.S.C. 154(b) by 0 days.

(21) Appl. No.: 10/372,458

(22) Filed: Feb. 21, 2003

(65) Prior Publication Data

US 2004/0164066 A1 Aug. 26, 2004

(51) Int. Cl.
*H05B 1/00* (2006.01)

(52) U.S. Cl. ..... 219/211; 219/528; 219/529; 219/545; 219/549; 392/497

(58) Field of Classification Search ..... 219/211, 219/212, 213, 528, 545, 549, 200, 529; 392/398, 392/497, 478

See application file for complete search history.

(56) References Cited

U.S. PATENT DOCUMENTS

| | | | | | |
|---|---|---|---|---|---|
| 1,358,509 | A | | 11/1920 | Birkenfeld | |
| 1,691,472 | A | | 11/1928 | Graham et al. | |
| 2,329,766 | A | * | 9/1943 | Jacobsen | 219/211 |
| 2,342,744 | A | | 2/1944 | McCready | |
| 2,458,119 | A | | 1/1949 | Van Daam | |
| 3,644,705 | A | * | 2/1972 | Johnson | 219/211 |
| 3,729,613 | A | | 4/1973 | Deloire et al. | |
| 3,858,028 | A | | 12/1974 | Kerr | |
| 3,989,924 | A | | 11/1976 | Kurtzer | |
| 3,999,037 | A | | 12/1976 | Metcalf, Sr. | |
| 4,061,897 | A | * | 12/1977 | Thykeson | 219/211 |
| 4,087,675 | A | | 5/1978 | Sansonetti | |
| 4,273,989 | A | | 6/1981 | Hinton et al. | |
| 4,404,460 | A | | 9/1983 | Kerr | |
| 4,439,666 | A | * | 3/1984 | Graham | 219/213 |
| 4,659,905 | A | * | 4/1987 | Gabrosek et al. | 219/212 |
| 4,713,531 | A | * | 12/1987 | Fennekels et al. | 219/545 |
| 4,764,665 | A | | 8/1988 | Orban et al. | |
| 4,777,344 | A | | 10/1988 | Nash et al. | |
| 4,825,039 | A | * | 4/1989 | Yoo | 219/212 |
| 5,008,517 | A | | 4/1991 | Brekkestran et al. | |
| 5,023,430 | A | | 6/1991 | Brekkestran et al. | |
| 5,032,705 | A | | 7/1991 | Batcheller et al. | |
| 5,105,067 | A | | 4/1992 | Brekkestran et al. | |
| 5,148,002 | A | | 9/1992 | Kuo et al. | |
| 5,221,827 | A | * | 6/1993 | Marsden et al. | 219/200 |
| 5,229,583 | A | * | 7/1993 | van Egmond et al. | 219/549 |
| 5,541,388 | A | | 7/1996 | Gadd | |
| 5,777,296 | A | | 7/1998 | Bell | |
| 5,866,881 | A | | 2/1999 | Jones, III | |
| 5,977,517 | A | * | 11/1999 | Grosjean | 219/211 |
| 6,049,062 | A | | 4/2000 | Jones | |
| 6,049,063 | A | * | 4/2000 | Barber | 219/213 |
| 6,054,178 | A | * | 4/2000 | Howells | 427/209 |
| 6,239,410 | B1 | * | 5/2001 | Tackore | 219/211 |
| 6,649,873 | B1 | * | 11/2003 | Cintron et al. | 219/211 |
| 6,696,674 | B1 | * | 2/2004 | Doornsbosch | 219/528 |

* cited by examiner

*Primary Examiner*—Robin Evans
*Assistant Examiner*—Leonid Fastovsky

(57) ABSTRACT

A thermal garment that utilizes an electrically-conductive, all metal mesh fabric for the uniform distribution of heat throughout the surface area of the garment, thus permitting freedom of movement without sacrifice to the structural integrity of the fabric, a seemingly prevalent prior art disadvantage recognized in thermal garments incorporating electrical heating wires and/or metalized textile fabrics.

3 Claims, 3 Drawing Sheets

THERMAL GARMENTS

TECHNICAL FIELD

The present invention relates generally to electrically-heated apparel, and more specifically to thermal garments designed to provide uniform distribution of heat. The present invention is particularly applicable to, although not strictly limited to, the development of an array of heated winter apparel.

BACKGROUND OF THE INVENTION

To better endure the implements of harsh weather conditions typically associated with the fall and winter seasons, attempts have been made to develop and utilize electrically-heated apparel in attempts to maintain a more comfortable body temperature. In general, however, most available electrically-heated apparel possess inherent disadvantages that render their use highly inefficient, impractical and problematic.

Specifically, most available electrically-heated apparel are typically heated via a plurality of electrical heating wires woven or coiled throughout the garment, wherein application of a power source (i.e., batteries, AC or DC power sources) to the electrical heating wires causes the wires to produce and release heat. Examples of such devices may be seen with reference to U.S. Pat. No. 2,329,76 to Jacobsen, U.S. Pat. No. 4,404,460 to Kerr, U.S. Pat. No. 5,008,517 to Brekkestran et al. and U.S. Pat. No. 5,032,705 to Batcheller et al. However, utilization of a plurality of segregated electrical heating wires in thermal garments bear obvious disadvantages.

For instance, thermal garments possessing a plurality of segregated electrical heating wires typically hinder flexibility of the garment, restricting or recognizably limiting the wearer's freedom of movement. Furthermore, a plurality of segregated electrical heating wires in garments generally produce a concentrated, localized, and generally non-uniform, dispersion of heat; thus, heating only specific areas or points of the wearer's body. Although the above-referenced U.S. patents have attempted to remedy the non-uniform or localized production of heat generated from electrical heating wires via the incorporation of a plurality of tightly coiled and/or serpentine wire configurations woven throughout the garment, such designs typically result in the aforementioned disadvantageous creation of a restrictive or non-pliable garment.

As a result of the restrictive nature of thermal garments laden with electrical heating wires, much of a wearer's movement within such garments is typically forced. Such forced bodily motions within garments having electrical heating wires have significant bearing on the preservation of wire yield strength, wherein excessive, continuous, general and/or forced movement within the garment results in the heating wires breaking at the stress points where yield strength has been diminished. As such, a break in the electrical heating wire results in safety-related concerns and in the cessation of current past the breakpoint, and thus, the non-heating of the associated area of the garment.

Although some thermal garments that eliminate the need for electrical heating wires as a heat producing means are available, these types of garment also possess clear disadvantages. For instance, U.S. Pat. No. 4,764,665 to Orban et al. discloses electrically heated gloves formed from a woven fabric that is metalized after being formed into the glove structure so as to maximize heat generated by the configuration of the fabric in the glove. The Orban et al. device is, however, disadvantageous, as the woven fabric utilized therein is a conventional textile fabric such as cotton or polyester, which can present significant patent and latent defects when metalized. More specifically, due to the pliability of textile fabrics, a metal coating applied to such fabrics formed into a garment will undergo significant yield and tensile stress when subject to the forces commonly associated with general body movement. As such, areas of the fabric where the yield and/or tensile strength has been diminished will generally result in the cracking and/or flaking of the metal coating, thus creating points of discontinuities in the metalized fabric, wherein such points of discontinuities cause interruptions and/or cessations of electrical current therepast, yielding an unevenly heated thermal garment.

Therefore, it is readily apparent that there is a need for a thermal garment that creates a uniform distribution of heat throughout the surface area of the garment, wherein the thermal garment promotes general bodily movement without diminishing the structural integrity of the fabric.

BRIEF SUMMARY OF THE INVENTION

Briefly described, in a preferred embodiment, the present invention overcomes the above-mentioned disadvantages and meets the recognized need for such a device by providing a thermal garment that utilizes an electrically-conductive, all metal mesh fabric for the uniform conduction of electrical energy and distribution of heat throughout the surface area of the garment; thus, permitting freedom of movement without sacrifice to the structural integrity of the fabric, a seemingly prevalent disadvantage recognized in thermal garments incorporating electrical heating wires and/or metalized textile fabrics.

According to its major aspects and broadly stated, the present invention in its preferred form is a thermal garment having an electrically-conductive, all metal mesh fabric disposed between insulative fabric layers, a control mechanism, and a power source.

More specifically, the present invention is a thermal garment having an electrically-conductive, all metal mesh fabric disposed between insulative fabric layers, wherein a control mechanism and a power source, preferably in the form of a battery, are electrically coupled to the metal mesh and preferably positioned thereon, or proximal thereto. The control mechanism is preferably utilized to selectively transfer and control the amount of voltage or current drawn from the battery, over the metal mesh, wherein the amount of voltage or current applied thereacross is directly proportional to the amount of heat generated thereby.

Accordingly, a feature and advantage of the present invention is its incorporation of an electrically-conductive, all metal mesh fabric as the heat generating source.

Another feature and advantage of the present invention is its ability to consistently and uniformly distribute heat throughout the surface area of the garment.

Another feature and advantage of the present invention is its ability to permit freedom of movement without sacrifice to the structural integrity of the fabric.

Another feature and advantage of the present invention is its ability to provide a thermal garment that eliminates the need for electrical heating wires and/or metalized textile fabrics as the heat generating source.

Another feature and advantage of the present invention is its ability to provide an uninterrupted flow of current throughout the electrically-conductive, all metal mesh fabric.

A feature and advantage of the present invention is its simplicity of design.

A feature and advantage of the present invention is its durability.

A feature and advantage of the present invention is its light weight.

These and other objects, features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATIVE EMBODIMENTS

Figure 1:
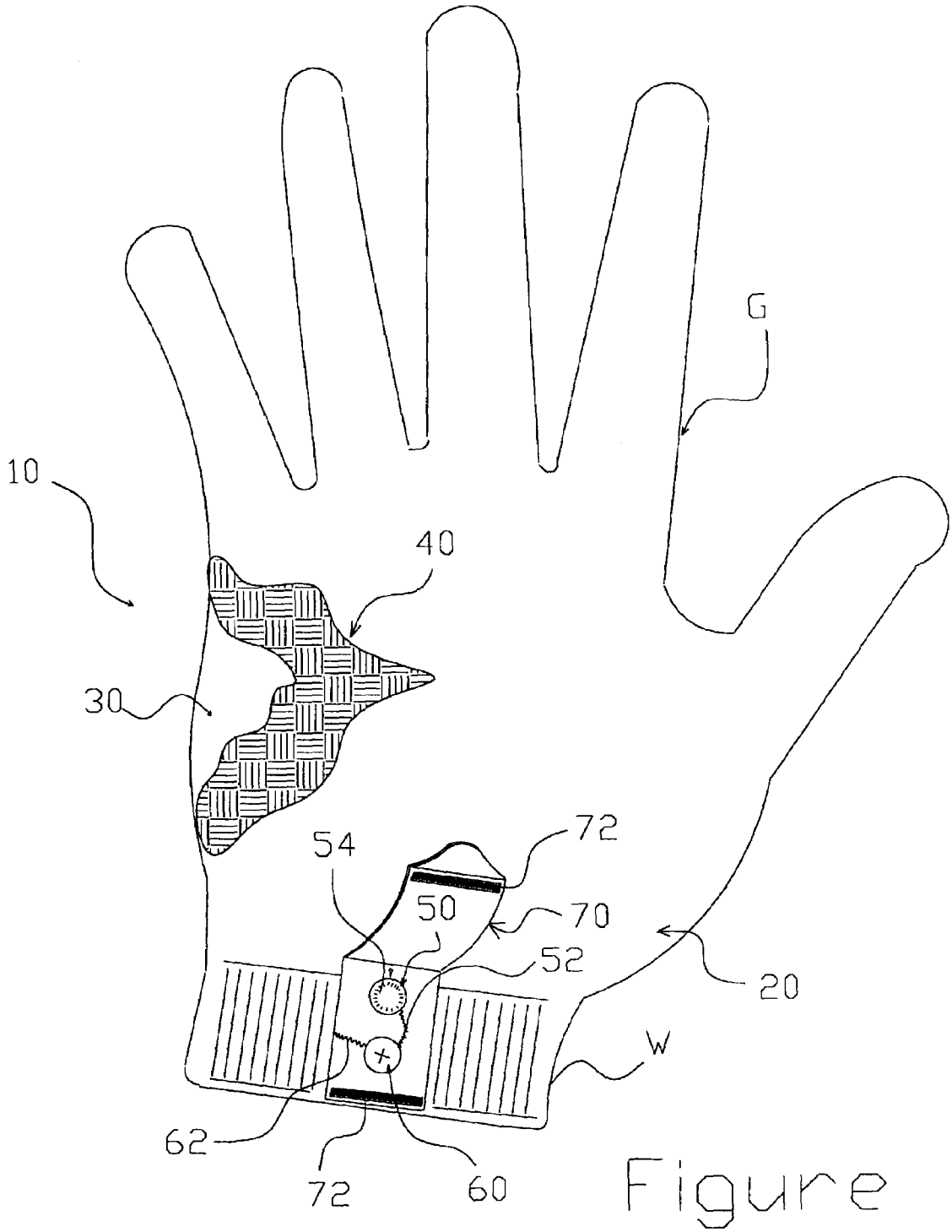
FIG. 1 is a partial cutaway view of a thermal garment according to a preferred embodiment of the present invention.
Figure 2:
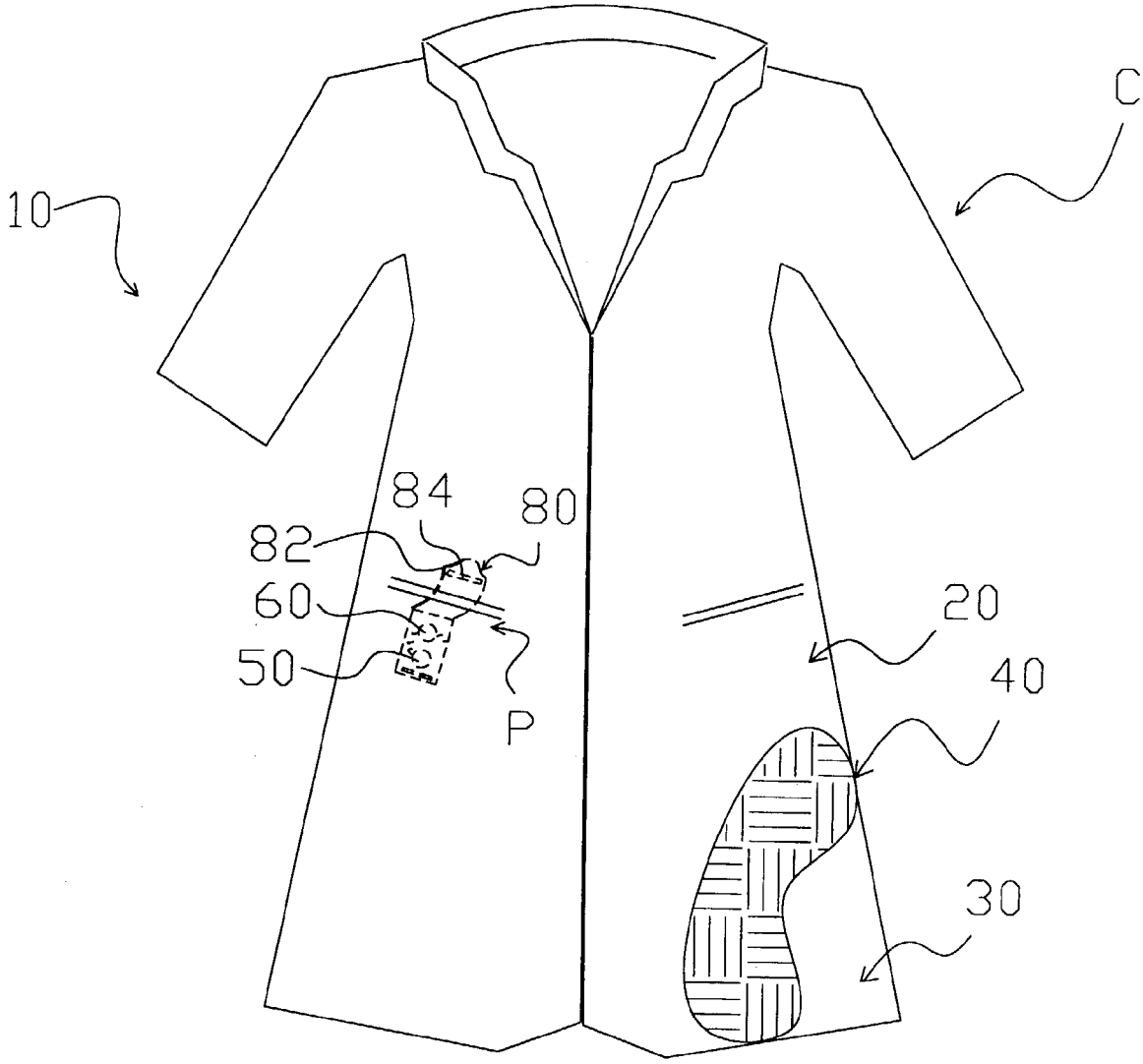
FIG. 2 is a partial cutaway view of a thermal garment according to an alternate embodiment of the present invention; and, FIG. 3 is a partial cutaway view of a thermal garment according to an alternate embodiment of the present invention.
Figure 3:
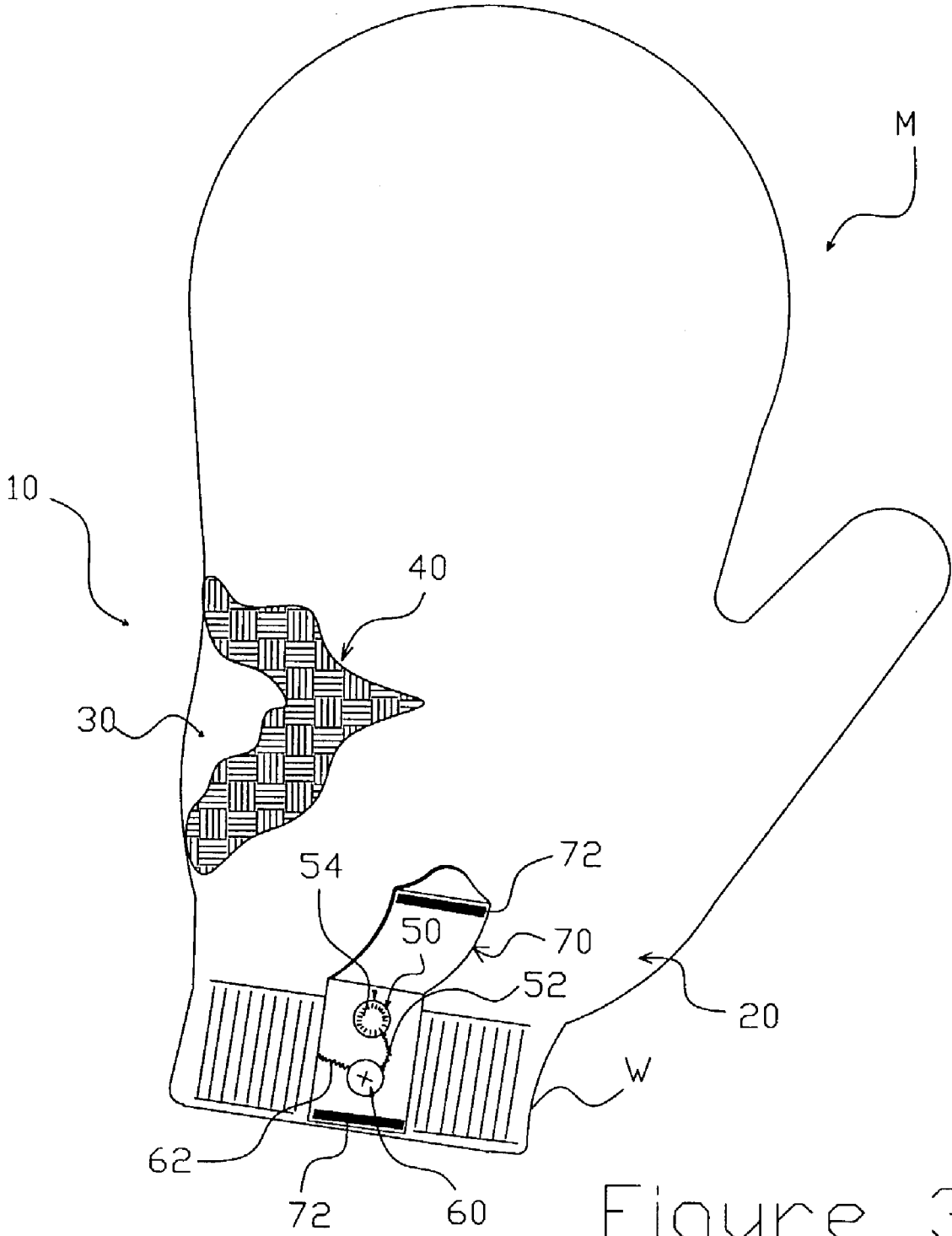

In describing the preferred and alternate embodiments of the present invention, as illustrated in FIGS. 1–3, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIG. 1, the present invention in a preferred embodiment is a thermal garment 10, wherein thermal garment 10 of FIG. 1 is preferably represented therein as glove G; although, it will be recognized by those ordinarily skilled in the art that other garment types could be utilized without departing from the appreciative scope of the present invention, as such additions and/or modifications are known within the art and in full contemplation of the inventors in describing the present invention herein and as more fully described below. Thermal garment 10 preferably generally comprises outer insulative fabric layer 20, inner insulative fabric layer 30, conductive fabric 40, control mechanism 50, and power source 60.

Preferably, outer insulative fabric layer 20 and inner insulative fabric layer 30 are formed from any suitable insulative fabric, such as, for exemplary purposes only, nylon quilted fabrics, polyester quilted fabrics, goose down, wool, mohair, fleece, cotton, acetate, combinations of same, and/or any other textile fabric suitable for the recognized purpose.

Preferably disposed between outer insulative fabric layer 20 and inner insulative fabric layer 30, is conductive fabric 40, wherein conductive fabric 40 is preferably an electrically-conductive, all metal, knitted mesh fabric, such as that manufactured by Laird Technologies (a unit of the Laird Group PLC, and headquartered in Delaware Water Gap, Pa.), for use as EMI and RFI shielding materials in the telecommunication, computer, aerospace engineering, and electronics industries. Although conductive fabric 40 is preferably an all metal, knitted mesh fabric, it is contemplated in an alternate embodiment that conductive fabric 40 could be an all metal, non-woven fabric, manufactured via any suitable means known within the art.

It is preferred that conductive fabric 40 be an all metal fabric, and not a metalized textile fabric utilized in the prior art, wherein the inherent pliability of the underlying textile fabric causes the metal coating applied thereon to undergo significant yield and tensile stress when subject to the forces commonly associated with general body movement. As a result, such prior-art metalized textile fabrics develop areas of diminished yield and/or tensile strength, thereby leading to cracking and/or flaking of the metal coating, and thus, points of discontinuities in the metalized fabric, wherein such points of discontinuities cause interruptions and/or cessations of electrical current therepast, yielding an unevenly heated thermal garment.

Preferably, the all metal, knitted mesh structure of conductive fabric 40 is formed from alloys of copper and nickel, or alloys of steel, copper and tin; although other suitable electrically conductive metal alloys could also be utilized. Preferably, the all-metal structure of conductive fabric 40 permits the continuous, uninterrupted flow of electrical current thereacross, and thus, the uniform generation and dispersion of heat therefrom, as more fully developed below.

Preferably, control mechanism 50 and power source 60 cooperatively function to regulate and control the amount of electrical current passed across conductive fabric 40, and thus the amount of heat generated therefrom. Specifically, control mechanism 50 is preferably electrically coupled to power source 60 via electrical coil 52, wherein power source 60 is preferably a lithium ion battery or nickel-cadmium battery, or any other suitable power source, capable of storing and delivering sufficient energy for sustained heating of glove G, or any other garment, for a user-selected period of time.

User-selective manipulation of control mechanism 50 to a desired heat setting or level, as delineated on control mechanism 50 as heat setting indicia 54, preferably functions to selectively transfer and control the amount of voltage or current drawn from power source 60, over conductive fabric 40, as known within the art, wherein the amount of voltage or current applied thereacross is directly proportional to the amount of heat generated thereby. Preferably, voltage or current is transferred to conductive fabric 40 via electrical coil 62 of power source 60, wherein electrical coil 62 is preferably coupled to conductive fabric 40. It will be recognized that ancillary circuit means, well known in the art, may be provided in association with control mechanism 50 to modify the resistive voltage drop and other electrical characteristics of the circuit for conforming the heat-developing characteristics of the garment to a user-acceptable functionality. It will be further recognized that control mechanism 50 may be in the form of a rotary-dial, multi-setting switch, touch-pad, slider-bar, or any other user-selectable control means.

Preferably, control mechanism 50 and power source 60 are positioned on wrist area W of glove G, and preferably concealed via flap 70, wherein flap 70 preferably utilizes hook-and-loop fastening mechanism 72 for removable securement to wrist area W; although other suitable fastening mechanisms could be utilized, such as, for exemplary purposes only, snap-buttons. It is further contemplated that control mechanism 50 and power source 60 could be positioned within glove G, or any other area thereon.

Referring now more specifically to FIG. 2, illustrated therein is an alternate embodiment of thermal garment 10, wherein the alternate embodiment of FIG. 2 is substantially equivalent in form and function to that of the preferred embodiment detailed and illustrated in FIG. 1 except as hereinafter specifically referenced. Specifically, the thermal garment embodiment of FIG. 2 is in the form of a coat C, wherein control mechanism 50 and power source 60 are preferably contained within pocket P of coat C, and enclosed within inner pocket 80. Inner pocket 80 possesses flap 82, wherein flap 82 is removably securable over inner pocket 80 via hook-and-loop fastening mechanism 84.

Referring now more specifically to FIG. 3, illustrated therein is an alternate embodiment of thermal garment 10, wherein the alternate embodiment of FIG. 3 is substantially equivalent in form and function to that of the preferred embodiment detailed and illustrated in FIG. 1 except as hereinafter specifically referenced. Specifically, the thermal garment embodiment of FIG. 3 is in the form of a hand mitten M.

It is contemplated in an alternate embodiment that thermal garment 10 could be any desired garment, such as, for exemplary purposes only, gloves, jackets, coats, socks, pants, shirts, underwear, outerwear, hats, headbands, earmuffs, shoes, boots, shoe or boot liners, coat liners, scarves, body blankets, throws, covers, ponchos, water-proof garments, or the like.

It is contemplated in another alternate embodiment that thermal garment 10 could possess any number of control mechanisms 50 with associated power sources 60 for selectively regulating sections of thermal garment 10.

It is contemplated in another alternate embodiment that thermal garment 10 could possess any number of control mechanisms 50 with associated power sources 60 for selectively regulating and setting different temperatures for different regions or sections of thermal garment 10.

It is contemplated in still another alternate embodiment that thermal garment 10 could possess a plurality of power sources 60 to attain a desired heat output and store a desired amount of energy.

It is contemplated in yet another alternate embodiment that the general concept of thermal garment 10 could be incorporated into any fabric-based item requiring uniform heating, such as, for exemplary purposes only, blankets, mattresses, or pillows.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A thermal garment, comprising:

a first fabric layer;

a second fabric layer;

an electrically conductive all metal non-woven mesh fabric interposed between said first fabric layer and said second fabric layer;

a power source electrically coupled to said electrically conductive all metal non-woven mesh fabric;

a control mechanism for controlling power drawn from said power source, said control mechanism comprising heat setting indicia thereon, said indicia corresponding to incremental heat levels; and, a flap articulately attached to either said first fabric layer or said second fabric layer, wherein said flap covers said power source and control mechanism.

2. The thermal garment of claim 1, wherein said first fabric layer and said second fabric layer are formed from an insulative garment fabric.

3. The thermal garment of claim 1, wherein said power source is electrically coupled to and regulated by said control mechanism for drawing an electrical current from said power source across said electrically conductive all metal non-woven mesh fabric for generation of heat thereby.

* * * * *